US005583471A

United States Patent [19]

Weiser et al.

[11] Patent Number: 5,583,471

[45] Date of Patent: Dec. 10, 1996

[54] CONTACT SPRING ARRANGEMENT FOR A RELAY FOR CONDUCTING AND SWITCHING HIGH CURRENTS

[75] Inventors: Josef Weiser; Robert Esterl; Gerhard Furtwängler; Horst Tamm, all of Bundesrepublik, Germany

[73] Assignee: Siemens Aktiengesellschaft, Munich, Germany

[21] Appl. No.: 335,741

[22] PCT Filed: May 13, 1993

[86] PCT No.: PCT/DE93/00419

§ 371 Date: May 9, 1995

§ 102(e) Date: May 9, 1995

[87] PCT Pub. No.: WO93/23863

PCT Pub. Date: Nov. 25, 1993

[30] Foreign Application Priority Data

May 15, 1992 [DE] Germany ..... 42 16 080.4
Feb. 18, 1993 [DE] Germany ..... 43 05 034.4

[51] Int. Cl.[6] ..... H01H 51/22

[52] U.S. Cl. ..... 335/78; 335/80; 335/83

[58] Field of Search ..... 335/78–80, 124–128, 335/129, 130

[56] References Cited

U.S. PATENT DOCUMENTS 3,419,828 12/1968 Bremer .
5,084,688 1/1992 Martino .

FOREIGN PATENT DOCUMENTS 0425780 8/1991 European Pat. Off. .
0471893 2/1992 European Pat. Off. .

*Primary Examiner*—Lincoln Donovan
*Attorney, Agent, or Firm*—Hill, Steadman & Simpson

[57] ABSTRACT

The contact spring arrangement has an elongated contact spring having a rigid connecting leg which extends approximately parallel to the contact spring and conducts the switching current in a direction opposite to the contact spring. On the side opposite the connecting leg the contact spring has a contact piece which co-operates with an opposite counter-contact element having a contact piece. The repulsive forces between the connecting leg and the contact spring become so long that even in the case of the highest short circuit currents no welding of the contacts results when in the case of contact pieces made from silver or a silver alloy the length of the gap formed between the contact spring and connecting leg is at least 20 times larger than the average spring spacing in the gap.

8 Claims, 3 Drawing Sheets

CONTACT SPRING ARRANGEMENT FOR A RELAY FOR CONDUCTING AND SWITCHING HIGH CURRENTS

BACKGROUND OF THE INVENTION

The invention relates to a contract spring arrangement for a relay for conducting and switching high currents having at least one elongated contact spring which carries a contact piece and co-operates with a fixed counter-contact element likewise carrying a contact piece, and having at least one rigid connecting leg for the contact spring, which extends approximately parallel to the latter while forming a spring gap on the side opposite the contact piece and which conducts the switching current in a direction opposite to the contact spring.

In order to connect appliances to a system voltage in the home and in industry, use is made of so-called miniature power relays which given a relatively small design including spring contacts cope into the region of 50 A with the current loads occurring in these applications. For higher currents, use is generally made of contactors which are equipped from the start for their fields of application with differently configured contact elements and correspondingly stronger drive systems, but which also consequently have substantially larger dimensions than the said relays.

Because of their small dimensions, it is frequently desired to use so-called miniature power relays in large scale installation practice, that is to say in service installations in office buildings, clinics and industrial plants. These relays are also immediately suitable for the currents occurring in normal switching operation. However, problems arise in the case of a short circuit in the wiring system or in the electrical loads, because in these cases, as well, the contacts of the relay are not to weld until the upstream protection system or protective member, for example a circuit breaker or a fuse, disconnects. The so-called prospective short circuit currents occurring in such cases are of the order of magnitude of 1,000 to 1,500 A and flow until the tripping of the protection system up to times of 3 to 5 ms over the closed contacts of the relay concerned. On the other hand, it can also happen that such a relay has to pull in in response to short circuit of this type. In the case of such a load, spring contact systems of conventional design run a high risk that the contact pieces will weld. On the one hand, in such relays the forces of the magnet system are not sufficient to produce a sufficiently high contact force for the currents which occur. On the other hand, in the case of parallel contact springs having current flowing in opposite directions the electrodynamic forces oppose the drive system, with the result that the contact force is additionally reduced thereby. However, owing to high-current-density forces in combination with the evaporation of contact material in the excessively hot contact touching zones an excessively small contact force leads to temporary lifting of the contacts, to the formation of an arc and, correspondingly, to welding when the contacts fall back.

In order to utilize the above-mentioned electrodynamic forces not to reduce but to increase the contact force, a design has already been proposed in German reference DE 40 26 425 C, in which the contact-making section of a contact spring surrounds the corresponding section of the other contact spring in the shape of a bow. The contact can be prevented from opening in the event of a short circuit by means of the current loop forces produced in this case. However, the surrounding loop has the disadvantage that the electric potential to be switched acts between the spring sections brought close to one another; in this case in normal switching operation sparking over of arcs can occur, as can destruction of the contact springs.

In known contact spring arrangements of the type mentioned at the beginning, in which a connecting leg for the contact spring extends on the side of the spring opposite the contact piece, it is true that the electrodynamic forces produce a certain repulsive effect which leads via the spring to a reinforcement of the contact force. However, in all these known instances, for example in the case of the relay according to European reference EP 0 425 780 A (corresponding to U.S. Pat. No. 5,084,688), the effect which can be achieved given the dimensioning there is not sufficient to prevent welding of the contact pieces in the event of short circuit currents of the above-mentioned type.

SUMMARY OF THE INVENTION

The aim of the invention is to specify for such a contact spring arrangement of the type mentioned at the beginning a dimensioning by means of which welding of the contact pieces can be reliably prevented even given the occurrence of very high short circuit currents. This aim is achieved according to the invention when the spring gap extends at least approximately over the entire length of the contact spring from its mounting point to the contact piece, and the ratio of the length to the spacing in the spring gap approximately satisfies the following condition when the contact is closed:

$$\frac{L}{D} \geqq \frac{2\pi}{\mu_o \cdot H_s}$$

where

L=length of the spring gap

D=average spacing in the spring gap $\mu_o$=magnetic field constant=1.256 $^{-}10^{-6}$ [Vs/Am]

$H_s$=limiting heating intensity or current-carrying capacity of the contact material $$\left[\frac{kA^2}{N}\right].$$

This formula is based on a simplified assumption for the mechanical behavior of the contact spring arrangement described. For example, the spring is regarded as a rigid body for the short time of action of the short circuit pulse (<5 ms). The positive effect in the experiment thus already begins at approximately ⅔ of the theoretical value of L/D.

Thus, according to the invention the spring gap formed between the contact spring and its connecting element is dimensioned such that the repulsive forces produced by the current loop which tend to close the contact located on the opposite side of the spring, are larger even in the case of the highest short circuit currents than the opposing forces which seek to open the contact. It was found that a simple dependence of the so-called limiting heating intensity or current-carrying capacity is yielded, which for its part is defined as a quotient of the welding limiting current strength [$kA^2$] and the contact force [N] and is a constant for a specific material. See the book by Keil, Merl, Vinaricky: "Elektrische Kontakte und ihre Werkstoffe" [Electrical Contacts and their Materials], Springer-Verlag, 1984, ISBN 3-540, 12233-8 for a definition of these terms.

The limiting heating intensity is $$H_s = 0.165 \left[ \frac{kA^2}{N} \right]$$

for silver and silver alloys, which chiefly come into question for the applications considered here. A value of 30 is calculated theoretically from this for the ratio of the length to the spacing in the spring gap. Thus, if the spring length in the gap is at least 30 times as large as the average spacing, welding of the contacts is prevented even in the case of the highest short circuit currents. It was found experimentally that this effect functions as early as from the value of 20.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENT

Figure 1:
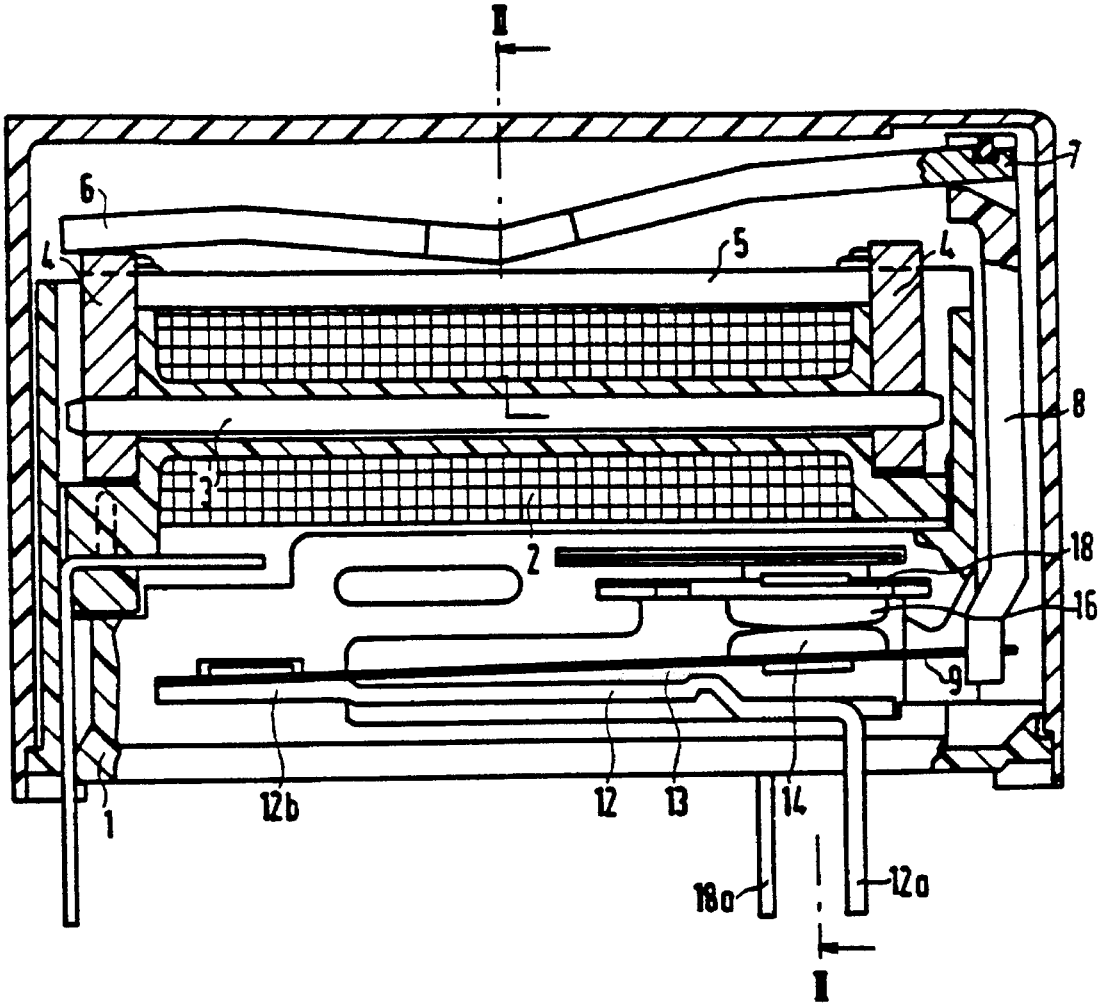
FIGS. 1 and 2 show in two sectional views a relay having contact elements configured according to the invention.
Figure 2:
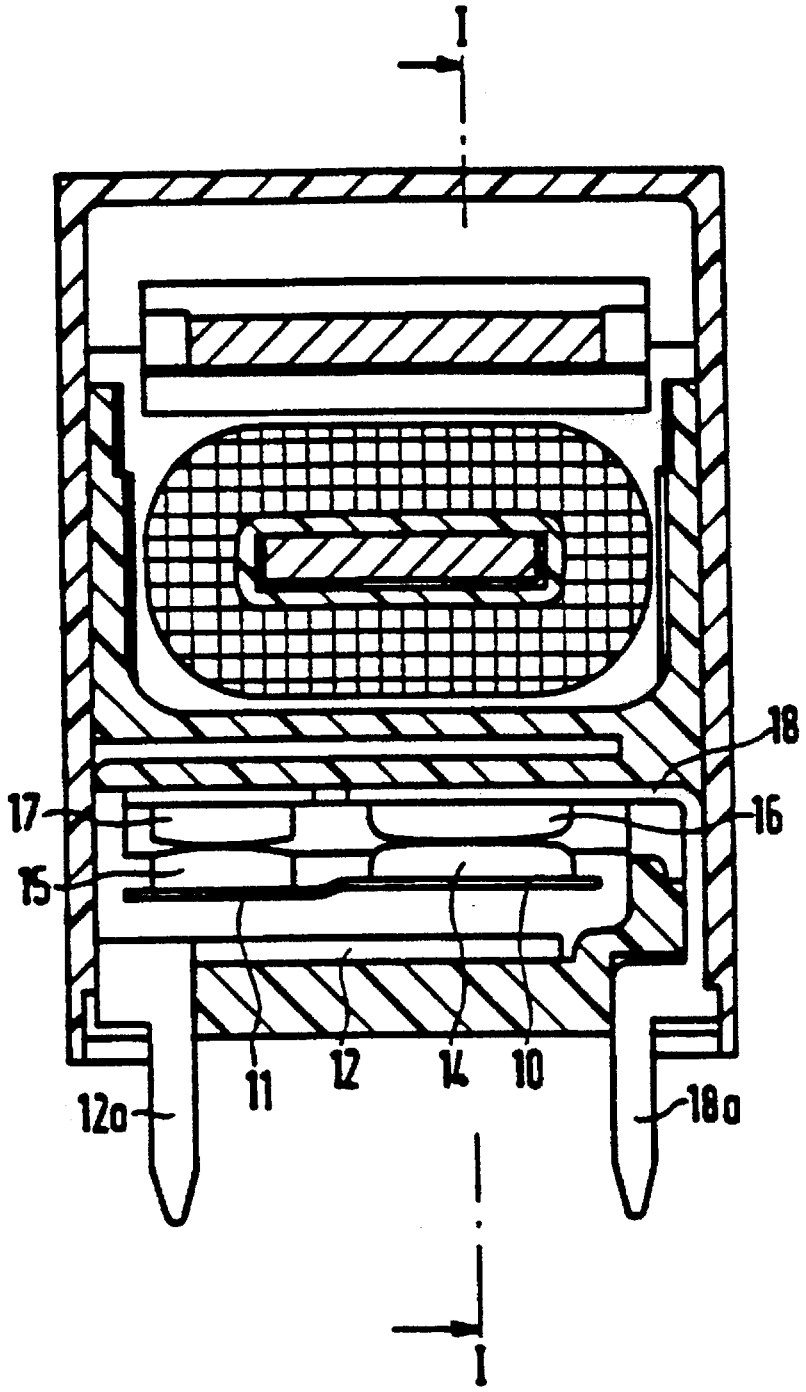

FIGS. 1 and 2 show a relay for use with heavy currents, whose contact arrangement is configured according to the invention. Arranged in a basic body 1 is a magnet system having, from the top, a coil, a core 3, two yokes 4, a permanent magnet 5 and a rocker armature 6. Via a slide 8, an operating finger 7 of the armature operates a contact spring 9 which in this example is split into a main spring leg 10 and an advance spring leg 11. A spring carrier 12 extends from its connecting pin **12*a* up to the mounting point 12*b* for the contact spring 9 approximately parallel to the latter, as a result of which a spring gap 13 is formed. The contact pieces 14 and 15 of the contact spring 9 are located above the connecting pin 12*a* on the side opposite the spring carrier 12. They interact with corresponding contact pieces 16 and 17 of a counter-contact element 18 which is anchored like the spring carrier 12 by being plugged into slots of the basic body and has a connecting pin 18*a***.

In the region between the contact piece 14 and the mounting point **12*b*, the spring carrier 12 is brought close to the contact spring 9 in such a way that the length of the spring gap 13 is more than 30 times, but at least 20 times, as large as the average spacing between the spring carrier 12 and contact spring 9. As a result, the repulsive force between the spring carrier 12 and the contact spring 9 is so strong in the case of high short circuit currents that a brief lifting of the contact piece 14 from the contact piece 16 is avoided and welding of the contact is prevented. The counter-contact element 18 is arranged in this case transverse to the spring carrier 12**. As a result, the moving contact spring is not opposite any large-area metal parts which could lead to the production of eddy-current forces. Such eddy-current forces could, otherwise, impair the desired repulsion of the current loop.

Figure 3:
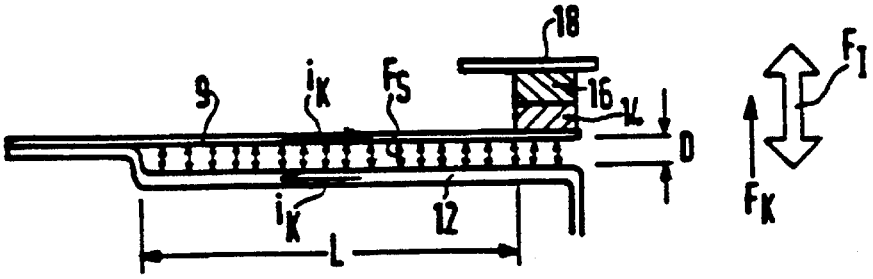
FIG. 3 shows a representation of the design principle according to the invention with reference to a diagrammatically shown contact spring arrangement.
Figure 5:
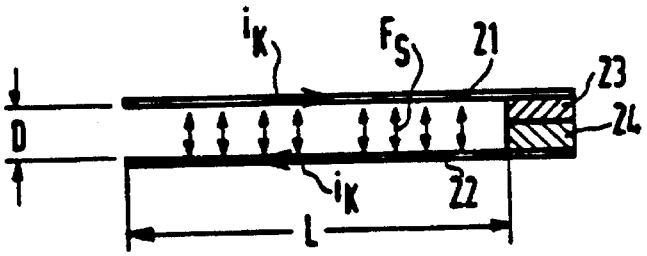

The physical considerations for dimensioning the above-mentioned current loop between the spring carrier 12 and contact spring 9 are now to be described more precisely by comparison with the prior art with the aid of FIG. 3 and 5.

FIG. 5 shows a conventional contact spring set having a switching contact spring 21 and a counter-contact spring 22 which each close a circuit respectively via contact pieces 23 and 24. If a high short circuit current has to be conducted via such contact springs, the following effect occurs: if the contact forces do not reach a prescribed value, because of high-current-density forces in combination with the evaporation of contact material in the excessively hot contact-touching zones and because of the development of high vapor pressures the closed contacts then briefly lift off; in this case, an arc is struck with the correspondingly high current intensity $i_K$, the contact surfaces fusing over a large area. Finally, the contact falls back into the melt of its own material and is welded.

In order to prevent this catastrophic event, it is necessary to prevent the contacts from opening owing to the production of adequate contact forces. The contact forces of less than 100 cN which can be achieved in the present-day relays with relatively small magnetic circuit volume are far too small for short circuit currents of the above-mentioned order of magnitude to prevent the described opening of the contacts in the case of a contact arrangement in accordance with FIG. 5. In this arrangement with oppositely directed conducting paths in the parallel, co-operating contact elements, electro-dynamic repulsive forces are produced which additionally counteract the contact force. Such contacts are thus opened in the case of high currents, and this additionally increases the risk of welding. The repulsive forces occurring in this case depend on the square of the current in accordance with the following relationship:

$$F_S = \frac{\mu_o}{2\pi} \cdot \frac{L}{D} \cdot i_K^2 = 0{,}2 \cdot \frac{L}{D} \cdot i_K^2 \cdot 10^{-6}\ [N]$$

where $\mu_o = 1{,}256 \cdot 10^{-6}$ [Vs/Am]

L=spring length

D=spring spacing $i_K$=contact current in [A]

$F_s$=force of the current loop in [N]

The forces $F_S$ of such designs in accordance with FIG. 5 are to be found at most in the region of below 50 cN since the spacing D is of the order of magnitude of twice the contact piece height. The decisive geometrical factor in this is the ratio of L/D, with numerical values of less than 10.

As mentioned at the beginning, German reference DE 40 26 425 C1 describes a measure which, by using contact springs which surround one another, aims to utilize the current loop in order to increase the contact force and in so doing to prevent the contacts from opening in the case of short circuits. However, there is the disadvantage in the case of the arrangement shown there, that the current loop is formed by two contact elements which conduct different potentials when contacts are open and thus bring about the risk of an arc in normal switching operation.

The form of the current loop used in the invention is represented once again diagrammatically in FIG. 3. Here, a current loop is formed between the spring carrier 12 and the contact spring 9 at the rear of the switching contact piece 14, use being made of a good electrical conductor as spring carrier 12 made from copper, and of a spring, likewise made from a copper alloy which is adequately dimensioned for the current intensity $i_K$ to be conducted. This spring carries on the switching side the contact piece 14 which preferably comprises silver or a silver alloy such as AgCdO or $AgSnO_2$. When the contact is closed, the current flows in the spring carrier 12 opposite to the current direction in the contact spring 9. The spring and the metal part (spring carrier 12) are connected in an electrically conductive fashion at the point 12*a*. However, to the extent that such arrangements having the spring carrier and contact spring have formed such a current loop in known relays, the dimensioning was not selected in such a way that the repulsive force produced would have sufficed to prevent welding in the case of short circuiting.

The following balance of forces holds in the case of short circuiting for the current loop in FIG. 3:

$F_K+F_S \gtrsim F_I$.

Added to the actual contact force $F_K$ of the relay is the current dependent force $F_s$ of the current loop due to the current $i_K$ flowing oppositely in it. If these two forces are larger than the force $F_1$ of the current-carrying capacity, the contact pieces do not lift off in the case of a short circuit and are not welded; if they are smaller, the lifting process outlined earlier takes place, attended by the risk of welding of the contacts. In the case of normal short circuit currents (>1000 A), the actual contact force $F_K$ can be neglected by comparison with the loop force $F_s$, with the result that the previous relationship is simplified: $F_S \gtrsim F_I$.

It holds in addition that:

$$F_I = \frac{1}{H_s} \cdot i_K^2$$

where $i_K^2$ in [kA]

$$H_s \text{ in } \left[\frac{kA^2}{N}\right].$$

Using the physical regularities previously quoted and with $H_s$=0.165 for silver as contact material, the following simplified relationship is yielded for the equilibrium of forces:

$$0{,}2 \cdot \frac{L}{D} \cdot i_K^2 \gtrsim \frac{1}{0{,}165} \cdot i_K^2,$$

$i_K$ being specified in [kA].

Thus, the current is eliminated in this equation and the relationship:

$L/D \gtrsim 30$.

remains. Here D is the spring spacing averaged over the entire length L of the spring gap.

It may be seen that this "$i_K^2$—contact" itself adequately produces its required contact force independently of the current if the geometrical factor of the loop L/D>30 is ensured in terms of design. L/D is thus to be as large as possible. Theoretically, the current $i_K$ could be arbitrarily large, if not then there would be a limitation due to the conductivity of the other current-conducting elements in the contact circuit. Using this geometrical factor, the above equation yields forces of 6N or 600 cN given 1000 A or 1 kA. Experiments have also shown that values are positive as early as from L/D>20. However, the higher this factor is, the more reliably the welding of the contacts is prevented not only in the case of short circuiting via the closed contacts, but also in the case of pulling in in response to a short circuit. In this case, positively driven operation of the moving contact element with respect to the drive system of a relay has a favorable effect.

Advantageous embodiments of the principle of the contact loop result for a relay when the spring of the loop is divided into an advance contact having tungsten contact pieces and a main contact having contact pieces made from a silver alloy (AgCdO, $AgSnO_2$). This variant, represented in FIG. 1 and FIG. 2, has advantages in the switching of fluorescent tubes having corresponding current peaks. Double fitting with only contacts of one silver alloy is more cost effective for switching in the nominal current region. Fitting with a single contact is, of course, the most economical solution and is, however, sufficient in terms of service life for many applications.

In normal switching operation in the case of alternating current, the current loop produces in the closed contacts micro-oscillation effects which have an advantageous effect on the current transfer, that is to say on the contact resistance.

Figure 4:
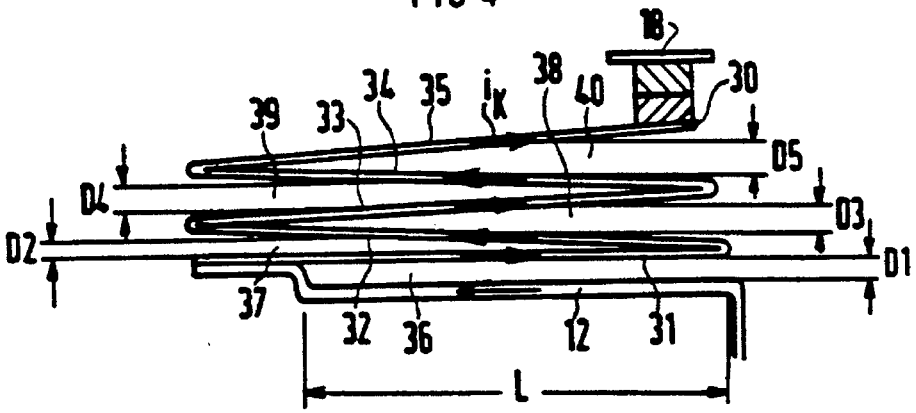
FIG. 4 shows a development of the invention having a multiply folded contact spring and FIG. 5 is shows a diagrammatic representation of a conventional contact spring arrangement in a relay for the purpose of illustrating the different mode of operation by comparison with the invention.

Another possibility is a development of the way in which the contact spring is folded in the manner of an accordion, as represented diagrammatically in FIG. 4. There, the folded contact spring 30 has five alternately oppositely extending sections, 31, 32, 33, 34 and 35 with the result that in conjunction with the spring carrier 12 five spring gaps having the corresponding average spacings of D1, D2, D3, D4 and D5 are formed. The sum of all the loop lengths L must then fulfill the above-mentioned conditions in relation to the average value of all the spacings D1 to D5, that is to say must have 20 times the value of the average gap spacing in the case of silver contacts. The spacings D1 to D5 could in this case be equal and, for example, be ensured by means of thin insulating films.

All types of magnetic circuit come into question as the magnetic drive system for the contact principle described. However, preference is to be given to vibration-proof, polarized, above all bistable magnet systems having a centrally mounted armature, for example in accordance with the exemplary embodiment of FIG. 1. The force of the magnet system can be coupled in in the region between the contact spring mount and the contact piece, but also in the region between the contact piece and the free end of the spring.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A contact spring arrangement for a relay for conducting and switching high currents comprising:

at least one elongated contact spring which carries a first contact piece and co-operates with a fixed counter-contact element carrying a second contact piece, at least one rigid connecting leg for the contact spring, the at least one rigid connecting leg extending approximately parallel to the contact spring while forming a spring gap on a side opposite the first contact piece and the at least one rigid connecting leg conducting a switching current in a direction opposite to the contact spring, the spring gap extending at least approximately over an entire length of the contact spring from a mounting point of the contact spring to the first contact piece, and a ratio of length to spacing in the spring gap approximately satisfies the following condition when the first and second contact pieces are closed:

$$\frac{L}{D} \geqq \frac{2\pi}{\mu_o \cdot H_s}$$

where

L=length of the spring gap

D=average spacing in the spring gap $\mu_o$=magnetic field constant=$1.256 \cdot 10^6$ [Vs/Am]

$H_S$=limiting heating intensity of current-carrying capacity of contact material $$\left[\frac{kA^2}{N}\right]$$

of the first and second contact pieces.

2. The contact spring arrangement as claimed in claim 1, wherein the ratio of the length of the spring gap to the spacing in the spring gap satisfies the following condition: $L/D \geqq 20$.

3. A contact spring arrangement for a relay for conducting and switching high currents comprising:

at least one elongated contact spring which carries a first contact piece and co-operates with a fixed counter-contact element carrying a second contact piece, at least one rigid connecting leg for the contact spring, the at least one rigid connecting leg extending approximately parallel to the contact spring while forming a plurality of spring gaps on a side opposite the first contact piece and the at least one rigid connecting leg conducting a switching current in a direction opposite to the contact spring, the plurality of spring gaps extending at least approximately over an entire length of the contact spring from a mounting point of the contact spring to the first contact piece, the plurality of spring gaps being lined up by folding the contact spring in the manner of an accordion, a sum of gap lengths satisfying the following relationship in relation to an average gap width, when the first and second contact pieces are closed:

$$\frac{\Sigma L}{D} \geqq \frac{2\pi}{\mu_o \cdot H_s}$$

where

L=length of the spring gap

D=average spacing in the spring gap $\mu_o$=magnetic field constant=$1.256 \cdot 10^{-6}$ $H_S$=limiting heating intensity of current-carrying capacity of contact material $$\left[\frac{kA^2}{N}\right]$$

of the first and second contact pieces.

4. The contact spring arrangement as claimed in claim 1, wherein the contact spring is subdivided into a main spring leg having a main contact piece made from a silver alloy and an advance spring leg having an advance contact piece made from tungsten.

5. The contact spring arrangement as claimed in claim 1, wherein the ratio of the length of the spring gap to the spacing in the spring gap satisfies the following condition: $L/D \geqq 30$.

6. The contact spring arrangement as claimed in claim 3, wherein the contact spring is subdivided into a main spring leg having a main contact piece made from a silver alloy and an advance spring leg having an advance contact piece made from tungsten.

7. The contact spring arrangement as claimed in claim 3, wherein the ratio of the length of the spring gap to the spacing in the spring gap satisfies the following condition.

8. The contact spring arrangement as claimed in claim 3, wherein the ratio of the length of the spring gap to the spacing in the spring gap satisfies the following condition.

* * * * *